United States Patent [19]

Porsch et al.

[11] 4,273,400

[45] Jun. 16, 1981

[54] PROTECTIVE MEANS FOR CRT BASE

[75] Inventors: Allan W. Porsch, Seneca Falls; Fred L. Sorensen, Waterloo, both of N.Y.

[73] Assignee: GTE Products Corporation, Stamford, Conn.

[21] Appl. No.: 101,387

[22] Filed: Dec. 7, 1979

[51] Int. Cl.[3] ..... H01R 13/44

[52] U.S. Cl. ..... 339/36; 206/329

[58] Field of Search ..... 339/36, 198 J, 213 R, 339/213 T; 206/328, 329, 418, 590

[56] References Cited

U.S. PATENT DOCUMENTS

| | | | |
|---|---|---|---|
| 2,861,250 | 11/1958 | Elwell | 339/36 |
| 3,423,717 | 1/1969 | Klier et al. | 206/328 X |
| 3,771,105 | 11/1973 | Yamazaki et al. | 339/36 |

*Primary Examiner*—Joseph H. McGlynn
*Assistant Examiner*—Frank H. McKenzie, Jr.
*Attorney, Agent, or Firm*—Theodore D. Lindgren

[57] ABSTRACT

The invention provides a one-piece protective cap, discretely formed of semi-rigid material, which encloses the major area of a CRT base. The cap, which maintains alignment of the connector pins of the tube, completely shields the vulnerable areas of the base from possible contamination, and thereby prevents the possible development of resultant leakage and arcing thereacross. The cap is retained on the base by the utilization of a plurality of spatially-related nubbins in the cap interacting with the sidewall of the base to provide a plurality of pressured retention areas.

5 Claims, 4 Drawing Figures

PROTECTIVE MEANS FOR CRT BASE

TECHNICAL FIELD

This invention relates to means for protecting a cathode ray tube base seated on the closure portion of the tube and more particularly to a cap-like structure formed to provide substantially full protection for the exposed base and connector pins of the tube.

BACKGROUND ART

Significant advancement in cathode ray tube technology, in particularly the tubes types utilized in television and allied display applications, has produced refinements in the compaction of efficient electron gun structures which are incorporated in tube envelopes having markedly reduced neck diameters. The operating potentials for the various elements of the gun structures are usually supplied via an annular array of connector pins sealed into and projecting from the header or stem closure portion of the tube. As the neck diameters and associated header closure portions become smaller, the spacings between the connector pins decrease in a proportionate manner.

Since many types of tubes evidence large voltage differentials between certain of the connector pins, it is imperative that the base spacings between pins, and the base surface in general, be kept free of deleterious materials to prevent the development of leakage and arcing paths thereacross.

Many base protectors in the prior art did not adequately shield the inter-spacings between pins, and other vunerable areas on the base surface, from foreign materials and liquids that may have inadvertently been deposited thereon. Consequently, the possible shorting-out and the development of leakage or low electrical resistance paths, resultant from the presence of these foreign substances, became important factors in determining the quality of the tube.

Base protectors often incorporate means for maintaining pin alignment, but unless the aforementioned base areas are shielded between the final stages of tube manufacturing, as well as during transportation and storage, the final operational quality of the tube is in jeopardy.

DISCLOSURE OF THE INVENTION

The present invention is addressed to protective means for use on a cathode ray tube base seated on the closure header of the tube. In the conventional tubebase combination, the substantially annular array of tube connector pins protrude exteriorly through a plurality of aligned apertures in the circular flange-like member of the base structure. An integral central hollow crown portion, with a terminal aperture therein, suitably encloses the sealed exhaust tubulation of the tube.

The protective means of the invention is in the form of a one-piece cap-like structure having a central cylindrical hollow body member formed of a curved sidewall having a closed terminal end and an opposed open end, wherein the central crown of the base is accommodated. The sidewall is of sufficient thickness to have formed therein a plurality of longitudinal bores to provide protective encompassment of the connector pins. An outstanding rim-like basal portion is integrally formed about the open end of the body member. A recess, formed inward from the bottom surface of the body member, is dimensioned to accommodate the major portion of the exposed surface of the flange member of the base. Retaining elements, in the form of spaced-apart nubbins, protrude inward from the wall of the recess to effect adhering engagement with the circumferential sidewall of the base when the cap is positioned to encompassingly seat on the base. The cap is formed of a material evidencing a degree of resilience to enable flexural movement of the rim portion of the cap when the nubbins make adhering contact with the sidewall of the base. Thus, there is provided a discretely structured resilient cap for shielding substantially the major portion of the exposed surface of the base. This cap, which is easily applied and removed, adequately protects the base from the inadvertent deposition of deleterious materials during storage and transportation.

PREFERRED MODE EMBODYING THE INVENTION

For a better understanding of the present invention, together with other advantages and capabilities thereof, reference is directed to the following specification and appended claims in connection with the aforedescribed drawings.

Figure 1:
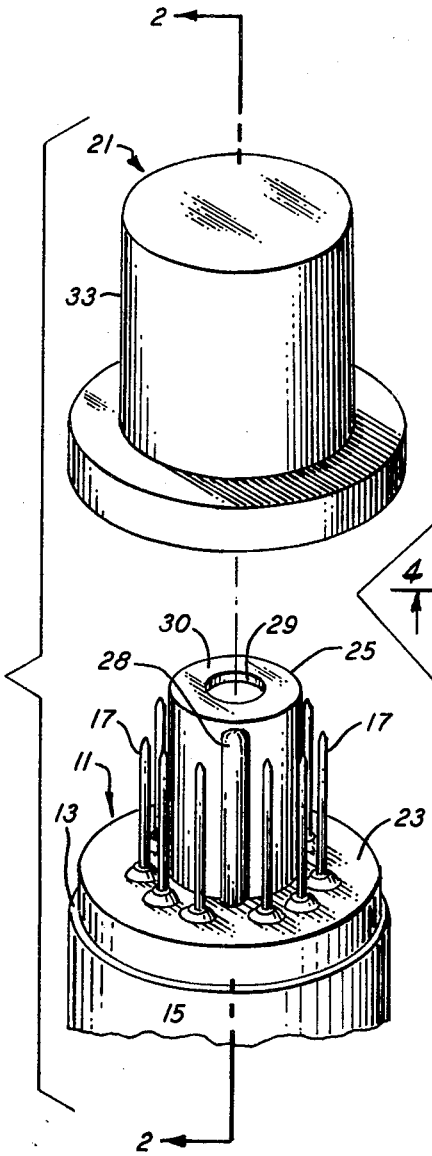
FIG. 1 presents exploded perspective views showing the manner in which the protective means of the invention are associated with the respective elements of the tube-base combination.
Figure 2:
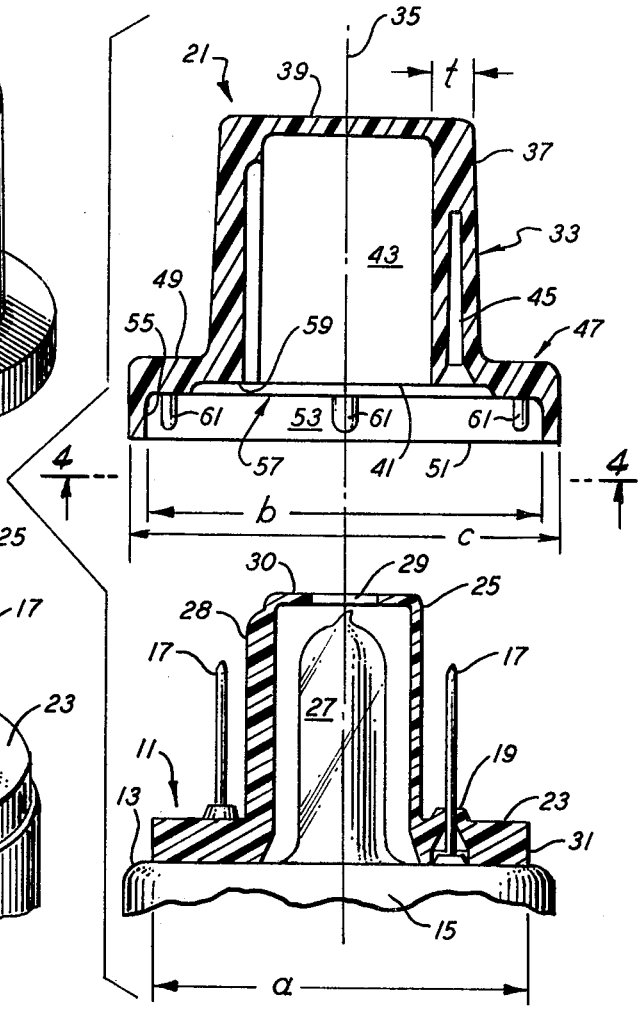
FIG. 2 shows exploded, sectional, elevational views taken along the line 2—2 of FIG. 1.

With reference to the drawings, there is shown in FIGS. 1 and 2 exploded presentations of a cathode ray tube base 11 seated on the neck closure or header portion 13 of the tube 15, in a manner whereby the terminal annular array of tube connector pins 17 protrude through a plurality of aligned apertures 19 in the base structure. Also shown, is the compatible base protective means of the invention in the form of a one-piece cap-like structure 21.

Referring to the drawings in greater detail, the tube base 11 comprises a circular flange-like portion 23 and an integral central hollow crown portion 25 fashioned to receive and protect the sealed exhaust tubulation 27. The exterior of the crown evidences a longitudinal positioning lug 28. Additionally, the crown portion 25 usually embodies a terminal aperture 29 formed centrally in the end surface 30. In addition to the aforementioned circular array of pin accommodating apertures 19, the flange portion 23 also evidences a circumferential sidewall 31 and a diametrical dimension "a".

The base protective means or cap 21 is comprised of a central substantially cylindrical hollow body member 33 having a longitudinal axis 35 therethrough. The curved sidewall portion 37 has a closed terminal end 39 and an opposed open proximal end 41. Thus, there is defined a cavity 43 which is proportioned to adequately accommodate the base crown portion 25 and the integral positioning lug 28 formed thereon. The cap sidewall 37 has sufficient thickness "t" to have formed therein a plurality of longitudinal bores 45, which extend inwardly from the proximal region 41 in exact alignment with the array of tube connector pins 17.

When the cap is applied to the base, the bores 45 provide spatial protective encompassment of each of the respective pins 17.

A substantially planar rim-like basal portion 47 is formed in an annular outstanding manner from the sidewall defining the open proximal end 41 of the body member 33. This rim-like structure 47 has an alpha surface 49, a beta surface 51 and an external diameter "c" which is greater than the external diameter "a" of the base 11. A circular recess 53, formed inward from the beta surface 51 in the rim-like portion 47, has a peripheral wall 55, a seating surface 57, a bottom circular surface 59 and a diameter "b" which is slightly greater than the diameter "a" of the base to enable the described recess 53 to encompass a major portion of the base flange member 23. The bottom surface 59 of the recess is that surface whereat the openings of the pin-accommodating longitudinal bores 45 are oriented.

A plurality of spaced-apart retaining elements, formed substantially as nubbins 61, are fashioned on the wall 55 of the recess in a manner to protrude inward therefrom toward the axis 35. Such is clearly delineated in FIG. 4. Since the circumscription 63 of the nubbins 61 is slightly smaller than the circumference of the base, the nubbins effect pressured or adhering engagement with the circumferential sidewall 31 of the base when the cap is positioned to encompassingly seat on the base.

Figure 4:
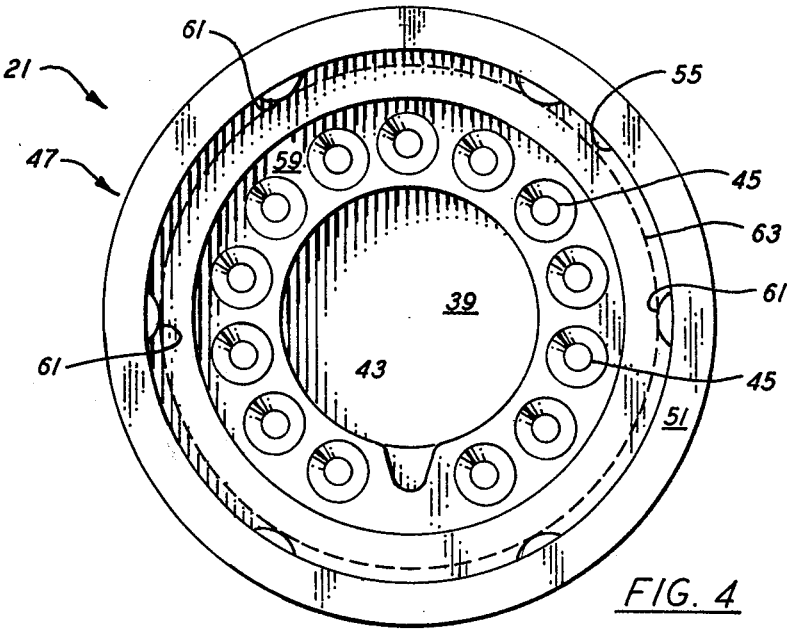
FIG. 4 is a bottom view of the invention taken along the line 4—4 of FIG. 2.

While adhering engagement between the nubbins and sidewall of the base can be realized through the employment of at least three nubbins, it is preferable to utilize a greater number of pressure areas. For example, six are shown in FIG. 4. The nubbins can be of various shapings, such as square, round, ovate or elongated. As illustrated, they are substantially elongated protuberances positioned substantially parallel with the axis 35, and extending substantially from the seating surface 57 to the vicinity of the beta surface plane 51.

The protective cap 21 is formed of a material evidencing a degree of resilience to enable limited flexural movement, particularly of the rib-like basal portion 47 when the nubbins 61 effect pressured areas against the sidewall of the base to effect the desired adherence. Suitable examples of materials evidencing the desired degree of resilience to facilitate a semi-stretched-fit on the rim of the base are semi-rigid rubber compositions and thermoplastics such as polypropylene and polyethylene.

Figure 3:
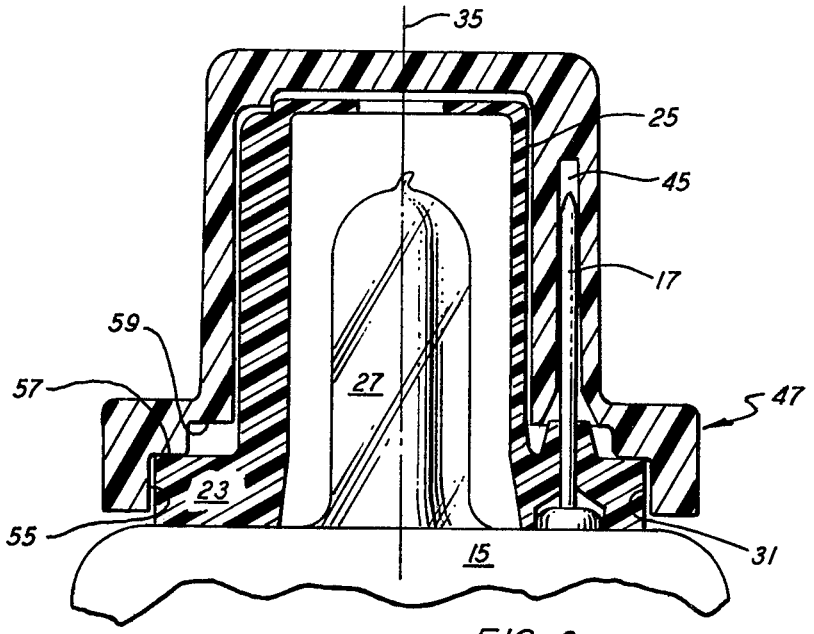
FIG. 3 is a sectional view illustrating the application of the protective means to the base structure.

The application of the cap 21 to the base 11 is illustrated in FIG. 3, wherein the axis 35 of the cap substantially coincides with that of the base. The base flange 23 abuts the annular seating ledge 57 which is removed from the bottom surface 59 of the recess 53. The tube connector pins are directed into the respective longitudinal bores 45 while the crown 25 and the integral positioning lug 28 are substantially spatially oriented within the cavity 43 of the cap. The resilience evidenced in the base portion 47 of the cap facilitates pressured adherence of the nubbins 61 to the edge 31 of the base to produce a stretched fit thereat thereby effecting positive retention of the cap to the base.

While there has been shown and described what are at present considered the preferred embodiments of the invention, it will be obvious to those skilled in the art that various changes and modifications may be made therein without departing from the scope of the invention as defined by the appended claims.

INDUSTRIAL APPLICABILITY

The invention, which has expeditious utilization particularly during the storage and transportation of cathode ray tubes, concerns a one-piece discretely formed protective cap-like structure which is capable of being facilely applied and removed from the base as desired. The cap, exhibiting a degree of resilience, utilizes a plurality of nubbins oriented to make spaced-apart pressured adherence with areas on the sidewall of the base, thereby effecting positive retention of the cap to the base. The semi-stretched fit consummated by the spatially-related nubbins pressure points makes application and removal of the cap easier than it would be in the absence of the nubbin areas. The cap affords complete protection for the vulnerable areas of the base thereby providing beneficial shielding from possible contaminants. In addition, the longitudinal bores insure alignment of the pins, and the cavity completely encloses the crown. Utilization of this protective cap enhances the final quality of the tube.

We claim:

1. Protective means for use on a CRT base seated on the closure header of the tube wherein a substantially annular array of tube connector pins protrude exteriorly from a circular flange-like member of the base structure through a plurality of aligned apertures therein surrounding a central hollow crown portion which encloses the sealed exhaust tubulation of the tube, said flange member having a circumferential sidewall and a diametrical dimension defining that of said base, said protective means being in the form of a one-piece cap-like structure comprising:

a central substantially cylindrical hollow body member having a longitudinal axis therethrough, and being formed of a curved sidewall portion having a closed terminal end and an opposed open proximal end thereby defining a central cavity proportioned to accommodate the crown portion of said base, said sidewall portion having sufficient thickness to have formed therein a plurality of longitudinal bores extending inwardly from said proximal end to effect spatial protective encompassment of said tube connector pins; a substantially planar outstanding rim-like basal portion formed about the open proximal end of said body member, said rim-like portion having alpha and beta surfaces and an external diameter greater than that of said base; a circular recess formed in said beta surface of said rim-like portion, said recess having a peripheral wall, a seating surface and a diameter slightly greater than that of said base to enable said basal portion recess to encompass a major portion of said base flange member when such is seated therein; and a plurality of spaced-apart retaining elements formed as nubbins are fashioned to protrude inward from the peripheral wall of said recess toward said axis, the protrusion of said nubbins being sufficient to effect adhering engagement with the circumferential sidewall of said base when said cap is positioned to encompassingly seat on said base.

2. The protective means for a CRT base according to claim 1 wherein said cap-like structure is formed of a material evidencing a degree of resilience to enable flexural movement of said rim-like basal portion when said nubbins are positioned in adhering contact with the circumferential sidewall of said base, said nubbins having a circumscription slightly smaller than the circumference of said base.

3. The protective means for a CRT base according to claim 1 wherein said nubbins are at least three in number.

4. The protective means for a CRT base according to claim 1 wherein said nubbins are formed as substantially elongated protuberances positioned substantially parallel with said axis, said protuberances extending substantially from said seating surface to the vacinity of the beta surface plane of said rim-like portion.

5. The protective means for a CRT base according to claim 1 wherein the seating surface in said recess is in the form of a circular ledge removed from a bottom circular surface of said recess.

* * * * *